US005881893A

United States Patent [19]

Manganiello

[11] Patent Number: 5,881,893

[45] Date of Patent: Mar. 16, 1999

[54] LEAKPROOF NIPPLE VALVE

[75] Inventor: Francis X. Manganiello, Pompton Plains, N.J.

[73] Assignee: Playtex Products, Inc., Westport, Conn.

[21] Appl. No.: 773,729

[22] Filed: Dec. 21, 1996

[51] Int. Cl.[6] ..... A61J 11/02; A61J 11/04

[52] U.S. Cl. ..... 215/11.5; 215/11.1

[58] Field of Search ..... 215/11.1, 11.4, 215/11.5

[56] References Cited

U.S. PATENT DOCUMENTS

| | | | |
|---|---|---|---|
| 2,174,361 | 9/1939 | Condon . | |
| 2,616,581 | 11/1952 | Madsen et al. . | |
| 2,688,326 | 9/1954 | Lerman | 215/11.1 |
| 2,753,067 | 7/1956 | Rodriguez | 215/11.1 |
| 2,889,064 | 6/1959 | Kurkjian | 215/11.1 |
| 2,980,113 | 4/1961 | Sappey et al. | 215/11.5 |
| 2,996,207 | 8/1961 | Witz | 215/11.1 |
| 3,113,569 | 12/1963 | Barr et al. | 215/11.1 |
| 3,203,569 | 8/1965 | Shomock et al. | 215/11.1 |
| 3,292,809 | 12/1966 | Shomock et al. | 215/11.5 |
| 4,505,398 | 3/1985 | Kesselring . | |
| 5,079,013 | 1/1992 | Belanger | 215/11.5 X |
| 5,474,028 | 12/1995 | Larson et al. | 215/11.5 X |

FOREIGN PATENT DOCUMENTS

| | | | |
|---|---|---|---|
| 397282 | 11/1990 | European Pat. Off. | 215/11.1 |
| 358010 | 10/1931 | United Kingdom . | |
| 1018822 | 2/1966 | United Kingdom | 215/11.1 |
| 1432798 | 4/1976 | United Kingdom | 215/11.5 |

*Primary Examiner*—Sue A. Weaver

*Attorney, Agent, or Firm*—Ohlandt, Greeley, Ruggiero & Perle

[57] ABSTRACT

A nipple for use with a baby bottle includes a flange having an upper surface, a lower surface, a cavity formed in the flange and through the lower surface, and a membrane formed in the flange above the cavity and through the upper surface. The cavity is contiguous with the membrane. The membrane has a perforation therethrough to form at least two resealable lips in the membrane. Preferably, the two resealable lips have an X-shape.

20 Claims, 1 Drawing Sheet

LEAKPROOF NIPPLE VALVE

The present invention relates to a pressure-equalizing valve in a nipple. More particularly, this invention relates to a valve that is cut or formed in the flange of a baby bottle nipple to provide enhanced pressure-equalizing performance during feeding, while minimizing or preventing leakage of fluid from the valve.

BACKGROUND OF THE INVENTION

Reusable, or hard, baby bottles with attached flexible nipples are commonly used to feed babies formula, water, and other liquids. One limitation associated with such bottles is the tendency of a vacuum to develop within the bottle during feeding. This can occur if, as the baby sucks liquid through the nipple, the liquid is not immediately replaced by air. This creates a pressure differential between the outside environment and the inside of the bottle causing the vacuum.

The vacuum created can, amongst other things, cause the nipple to collapse or cause the feeding portion, or tip, of the nipple to invert and be drawn toward the inside of the bottle. This prevents proper feeding, and may require loosening of the nipple and subsequent reassembly of the bottle. Furthermore, the vacuum created within the bottle can make feeding more difficult, requiring a greater sucking effort which may cause the baby to ingest more air.

The feed opening in the nipple may allow air into the bottle. However, it is insufficient to alleviate the vacuum formed in the bottle since that opening is typically occluded by fluid and the baby's mouth thereby preventing the flow of air therethrough into the bottle.

To address this problem of vacuum creation various pressure equalizing valves have been developed. Most valves require complex valving structures that are expensive to manufacture, difficult to clean, and that can present a potential danger to babies if disassembled and swallowed. Certain prior art nipples employ holes or vents formed in the nipple to allow air pressure to equalize. This structure is not effective as a valve since it does not prevent fluid leakage out through the holes, and does not control the inflow of air.

U.K. Pat. No. 1,432,798 to Yamauchi provides a valve that addresses some of these problems. This pierced-through valve has a small, dome-shape cavity in the nipple flange having stepped cross section. The outer, lower portion or dome-shape of the cavity is wider than the inner portion, and projects below the periphery of the flange. A slit, X-, Y- or I-shape, is then cut into the lower portion of the cavity to form an air passage. An annular rib is formed about the underside of the flange to support and protect the cavity.

U.S. Pat. No. 5,474,028 to Larson provides a check valve in a nipple for feeding animals. This valve is somewhat similar to the valve in the Yamauchi patent in that it projects below the flange. It is also formed in the upper surface of the flange. A supporting annulus or ring is built into the lower face of the nipple flange about the valve to support and protect it.

SUMMARY OF THE INVENTION

Against the foregoing background, it is a primary object of the present invention to provide a substantially leakproof nipple valve that alleviates the development of a vacuum or excess air within the bottle.

It is another object of the present invention to provide such a leakproof nipple valve that is easy and inexpensive to manufacture.

It is a further object of the present invention to provide such a leakproof nipple valve entirely in the flange of the nipple so that all enlarged areas about the flange are avoided.

To the accomplishment of the foregoing objects and advantages, the present invention comprises a nipple for use with a baby bottle, having a flange with an upper surface, a lower surface, a cavity formed in the flange and through the lower surface, and a membrane formed in the upper surface. The cavity extends partially through the flange, and contiguous thereto and above the cavity there is the membrane. The membrane is formed through the upper surface. The membrane has a cut therethrough to form at least two resealable lips in the membrane. Preferably, the two resealable lips have an X-shape.

The nipple can be made of silicone, rubber or other materials that are safe for baby nipples. In a preferred embodiment, the flange is preferably about 0.100 inches thick (not including the height of the annular rim 22, preferably 0.020 inches), the membrane 30 is preferably about 0.030 inches thick, and the cavity 28 is preferably about 0.070 inches deep. The two cuts of the X-shape cross-cut are preferably made at right angles to one another and preferably are of equal length. In and alternative embodiment, the cut has a Y-shape.

DESCRIPTION OF THE PREFERRED EMBODIMENTS

Figure 1:
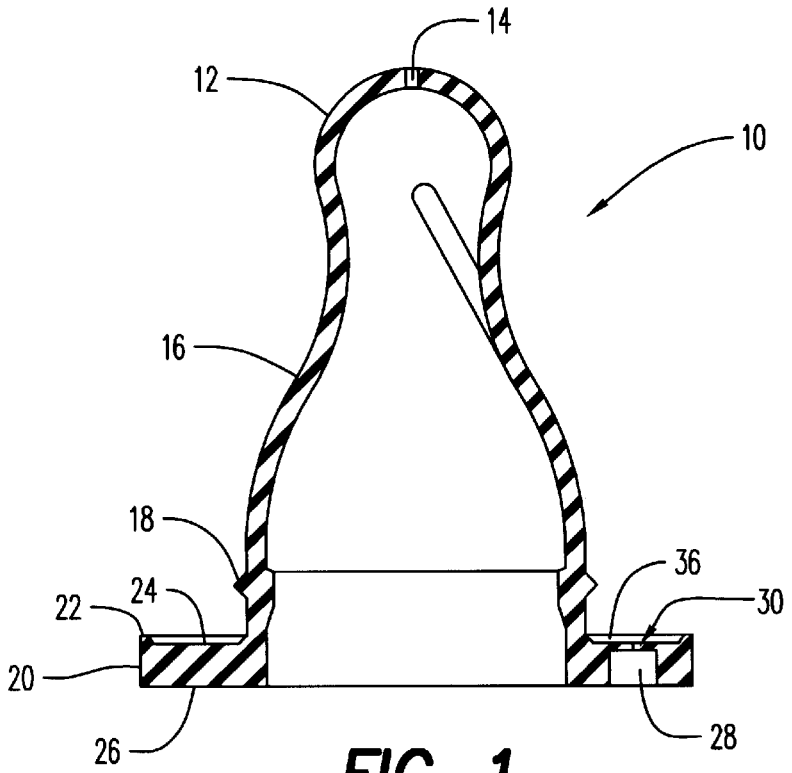
FIG. 1 is a cross-sectional view of a preferred nipple according to the present invention.

Referring to the drawings, and in particular FIG. 1, there is shown a preferred nipple according to the present invention, generally represented by reference numeral 10. The nipple 10 is designed for use in combination with a baby bottle (not shown). The baby bottle can be a plastic or glass (hard) bottle for dispensing liquids therefrom.

Referring to FIG. 1, the nipple 10 has a rounded tip 12 at its top end. The tip 12, which is shown as rounded, has an aperture 14 passing through its center to provide a conduit for the liquid to be dispensed from the bottle. The aperture 14 can be formed in any fashion and of any shape known in the art, such as a slit or slits. Below the rounded tip 12, the nipple 10 flares outward to form a torso 16. The torso 16 preferably has an annular ring 18 about its outer circumference, adjacent its lower end. Below torso 16, the nipple 10 terminates in a radial or horizontal flange 20. The flange 20 assists in mounting the nipple 10 in a retaining ring, and sealing the free edge of a bottle when the nipple is mounted onto the bottle.

The annular ring 18 of the torso 16 is offset a certain distance from the upper surface 24 of the flange 20. The ring 18 simply facilitates alignment and securing of the nipple 10 in the retaining ring.

The flange 20, which is substantially planar or flat, has a substantially flat upper surface 24, a substantially flat lower surface 26, and an annular rim 22. The annular rim 22 angles out from the flat upper surface 24 of the flange 20, and creates a raised ridge about the outer edge of the flange 20.

Figure 2:
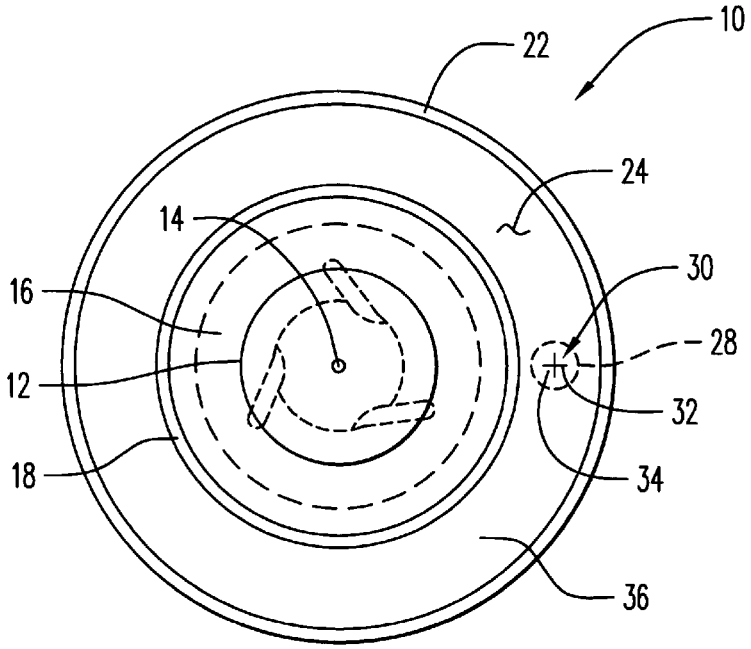
FIG. 2 is a top view of the nipple of FIG. 1.

Through the lower surface 26, there is formed within, or cut into it, a cavity 28. The cavity 28 is preferably cylindrical. Above the cylindrical cavity 28 and through upper surface 24, but within and a part of the flange 20, there is a thin membrane 30. As shown in FIG. 2, membrane 30 is preferably cut with an X-shape cross-cut 32 that forms a valve through which air can flow. The two cuts of the X-shape cross-cut 32 form four flaps 34. The flaps 34 control the functioning of the valve. The flaps 34 are normally closed or contact each other to prevent the flow of air into the bottle. Opening the valve allows air into the bottle when a vacuum is formed. Reclosing the valve prevents fluid outflow from the bottle when air pressure is substantially in equilibrium.

It has been surprisingly found that the specific dimensions of the cylindrical cavity 28, the membrane 30 and the cross-cut 32, synergistically cooperate to provide a nipple valve that is substantially leakproof under normal use conditions, and that properly responds to alleviate even a mild vacuum formed within the bottle. Moreover, this function is attained with a minimum of flange material and with a minimum amount of superfluous construction. Accordingly, this nipple valve is rapid and inexpensive to manufacture, and of consistent quality and performance.

The preferred dimensions of the valve can best be understood with reference to the figures. The two critical dimensions are the depth or thickness of the membrane 30, and the dimensions of the cross-cut 32, both absolutely and in relation to the width of the cavity 28.

The membrane 30 is preferably about 0.030 inches thick. A membrane of this thickness provides substantially improved valve functioning versus thicker or thinner membranes.

Thicker membranes have been found to be too resistant to deformation. Thus, only when a very substantial vacuum has built up within the bottle will the flaps 34 of the cross-cut 32 deflect to allow air in. This would require a greater sucking effort which would most likely result in nipple collapse and restricted liquid flow. On the other hand, if the membrane 30 is too thin, the weight of liquid bearing on its flaps 34 may permit leakage. In addition, in a very thin membrane, the flaps 34 may lose their resiliency too rapidly over time, preventing the flaps from resealing tightly.

Preferably, each of the two cuts of the X-shape cross-cut 32 will measure about 0.100 inches in length. This measurement is preferably about 0.025 inches less than the preferred diameter, which is about 0.125 inches, of the cavity 28.

The dimensions of the cross-cut 32 are important to the functioning of the valve. If the two cuts of the cross-cut 32 are too long, the flaps 34 will not have enough resiliency to open and reseal properly. If the two cuts of the cross-cut 32 are too short, the flaps 34 will be too stiff, and will not properly deflect under normal use conditions.

In turn, if the two cuts of the cross-cut 32 are too close to the edges of the cavity 28, they can, over time, begin to bend and deform along the edges of the cavity 28. This will of course allow leakage. If the two cuts of the cross-cut 32 are too distant from the edges of the cavity 28, the cross-cut will either be too small to be effective, or the size of the cavity 28 required will be too large to be practical.

The dimension of the cavity 28 may also be significant. As stated above, the cavity is a cylinder about 0.125 inches in diameter. The structure of the cavity 28 is important. It does not require any stepped-in surfaces to act as fluid funnels, nor does it require any supporting ribs or rings, as required by the prior art. Moreover, the body of the cavity 28 is formed in the flange 20. This contrasts with the prior art valves that show a cavity formed on an outwardly exposed or top surface of the flange 20. With the cavity located on the top surface of the flange—the broad opening of the cavity was facing outward—making it more difficult for the retaining ring to block the entire open area of the cavity.

The present invention has solved the airflow problem in a different, more efficient and more elegant fashion. First, as discussed, the cavity does not function as an air reservoir. As such, it does not need to be as large or as stepped in contour as those of the prior art. Thus, the valve of the present invention has a simpler and more durable structure. Also, it does not extend above or below the surface of the flange 20 and, thus, avoids the supporting ribs and rings required in the prior art valves.

The preferred embodiment nipple valve of FIGS. 1 and 2 functions as follows. The nipple 10 is inserted into a retaining ring (not shown). The retaining ring has a horizontal or radial portion for pressing down on the nipple flange, and a vertical or axial portion to screw or snap onto the neck of the bottle. The horizontal portion has a central nipple-receiving opening through which the tip and torso of the nipple are inserted. The annular ring 18 about the torso 16 slides through the central opening of the retaining ring and engages the top surface of the retaining ring so that the retaining ring is secured between the annular ring and flange 20. The annular rim 22 prevents the upper surface 24 of the flange 20 from sealing directly against the inner face of the retaining ring. Thus, a channel 36 is formed above the upper surface 24 of the flange 20 that functions as an air reservoir.

Moreover, a slight gap between the retaining ring opening occurs between the nipple 10 and the retaining ring at annular ring 18 and surface 24 when the nipple is compressed during baby sucking. This, in turn, allows air to flow into the channel 36 to feed air in the valve. With each suck, the nipple 10 is momentarily elongated and deflected, permitting the temporary passage of air in through channel 36 alongside the nipple. As the nipple 10 is released, between sucking motions, air will flow from the outside through this same temporary gap into the channel 36. This subtle bellows effect ensures optimal performance of the leakproof nipple valve.

In this preferred embodiment, the flange 20 is preferably about 0.100 inches thick or high. This dimension does not including the height of the annular rim 22, which is preferably about 0.020 inches high, so that the height of the flange at the rim is about 0.120 inches. The membrane 30 is preferably about 0.030 inches thick or high, as discussed above, so that the cavity 28 is preferably about 0.070 inches deep (height). The two cuts of the cross-cut 32 are preferably made at right angles to one another and preferably are of equal length. Moreover, the cuts preferably must pass entirely through the wall of the flange 20 along their full lengths. The depth or height of the channel 36 is preferably about 0.020 inches.

In addition, the inner edge of the annular rim 22 preferably slants approximately 30° from vertical, as viewed from the perspective of FIG. 1. The annular ring 18 preferably defines a right angle at its outermost edge and is about 0.062 inches high. The distance from the center of the annular ring 18 to the bottom of the flange 20 is preferably about 0.250 inches.

It should be noted that the foregoing dimensions and structures are selected based on the nipple material used. The nipple of the preferred embodiment of FIGS. 1 and 2 is preferably formed from silicone, which is resilient, durable, flexible and easy to clean. The foregoing dimensions are the preferred dimensions for use with a silicone nipple. If the nipple is to be formed of rubber or other materials, the dimensions will be modified to take into account the flexibility and resiliency of the material. Alternatively, the number of cavities formed can also be varied to accommodate the nipple material and bottle assembly to be used. One cavity is shown herein, but two or more can be used. Furthermore, while an X-shape cross-cut is preferred for use herein, other cuts such as single slits and Y-shape cuts can be used. The dimensions of the cuts may be varied to provide proper resistance to leakage.

FIG. 2 is a top view of the preferred embodiment nipple of FIG. 1. As can be seen therein, as in FIG. 1, the cavity 28 and cross-cut 32 are preferably located approximately at the radial center of the flange 20. This provides strength and durability to the nipple 10, and positions the cavity 28 within the sealing bead of the retaining ring (not shown) so as to access air passage through the inner opening of the retaining ring.

The invention having been thus described with particular reference to the preferred forms thereof, it will be obvious that various changes and modifications may be made therein without departing from the spirit and scope of the invention as defined in the appended claims.

What we claim is:

1. A nipple for use with a baby bottle, comprising:

a body having an aperture for emitting fluid from the bottle;

a flange integrally connected to said body having an upper surface, a lower surface, and a cavity formed partially through said flange and through said lower surface; and a membrane being formed above said cavity in said flange and in and through said upper surface, said membrane having a cut therethrough to form at least two contacting separable and resealable lips in said membrane.

2. The nipple of claim 1, wherein said cavity does not extend below said lower surface of said flange.

3. The nipple of claim 2, wherein said cavity does not extend above said upper surface of said flange.

4. The nipple of claim 1, wherein said cavity is cylindrical.

5. The nipple of claim 1, wherein said cavity is of uniform diameter.

6. The nipple of claim 1, wherein said cavity is about 0.125 inches in diameter.

7. The nipple of claim 1, wherein said cavity is about 0.070 inches deep, and said flange is about 0.100 inches thick.

8. The nipple of claim 1, wherein said cavity is about 0.070 inches deep, and said membrane is about 0.030 inches thick.

9. The nipple of claim 1, further comprising two intersecting cuts that form an X shape.

10. The nipple of claim 9, wherein each of said two cuts is about 0.100 inches long.

11. The nipple of claim 9, wherein said X-shape cuts are at right angles to one another.

12. The nipple of claim 9, wherein said cavity has a circumference, and wherein said cuts end about 0.012 inches from said circumference of said cavity.

13. The nipple of claim 1, wherein the nipple is adapted for use with a retaining ring having an inner face, and said flange includes a raised rim about an outer circumference thereof to prevent the upper surface of the flange from directly sealing against the inner face of the retaining ring.

14. The nipple of claim 1, wherein said body has an annular ridge-about a circumference thereof.

15. The nipple of claim 1, wherein said membrane is of uniform thickness.

16. The nipple of claim 1, wherein said membrane is about 0.030 inches thick.

17. A leak-resistant nipple valve, comprising:

a nipple flange having an upper surface and a cavity formed in said flange;

an integral membrane along and across said upper surface of said flange and above said cavity; and an X-shape cross-cut in said membrane.

18. The nipple of claim 17, wherein said cavity is about 0.070 inches deep and about 0.125 inches in diameter, said flange is about 0.100 inches deep, and said cuts are each about 0.100 inches long.

19. A nipple comprising:

a rounded tip having an aperture therethrough for dispensing fluid;

a rounded body below and contiguous with said rounded tip, said body having a notch about a circumference thereof; and an integral mounting flange below and contiguous with said body, said mounting flange having a top surface and a bottom surface, said mounting flange having a raised rim about a circumference thereof and a cylindrical cavity formed in said flange and positioned at and above the bottom surface, said mounting flange having two intersecting cuts in the top surface and above said cavity, wherein said two intersecting cuts and cavity form a pressure equalizing valve, wherein said mounting flange is adapted to be engaged by a retaining ring having an inner face to mount said nipple to a bottle, said valve is adapted to be covered by the retaining ring during use, and said rim is adapted to prevent the top surface of the flange from directly sealing against the inner face of the retaining ring.

20. The nipple of claim 19, wherein said cavity is about 0.070 inches deep and about 0.125 inches in diameter, said flange is about 0.100 inches thick, said membrane is about 0.030 inches thick, and said cuts are each about 0.100 inches long.

* * * * *